United States Patent [19]

LaBate, II

[11] Patent Number: 4,550,898

[45] Date of Patent: Nov. 5, 1985

[54] AIR COOLED REFRACTORY LANCE

[76] Inventor: Michael D. LaBate, II, 115 Hazen Ave., Ellwood City, Pa. 16117

[21] Appl. No.: 617,253

[22] Filed: Jun. 4, 1984

[51] Int. Cl.[4] ..... C21C 5/32

[52] U.S. Cl. ..... 266/220; 266/225; 266/266; 266/270

[58] Field of Search ..... 266/220, 225, 270, 266; 239/132.3

[56] References Cited

U.S. PATENT DOCUMENTS

| | | | |
|---|---|---|---|
| 3,082,997 | 3/1963 | Kurzinski | 266/225 |
| 3,115,405 | 12/1963 | Boyd | 266/225 |
| 3,223,398 | 12/1965 | Bertram et al. | 239/132.3 |
| 3,379,428 | 4/1968 | Dortenzo et al. | 239/132.3 |
| 3,521,872 | 7/1970 | Themelis | 266/226 |
| 3,751,019 | 8/1973 | Phillips | 239/132.3 |
| 3,898,078 | 8/1975 | Huber | 266/225 |

*Primary Examiner*—Peter K. Skiff
*Assistant Examiner*—Robert L. McDowell
*Attorney, Agent, or Firm*—Harpman & Harpman

[57] ABSTRACT

An air cooled refractory lance useful for either inert gas stirring or injection of oxygen into molten metal has an elongated refractory body having an axial bore terminating inwardly of one end in which several metal conduits are positioned with one of the conduits extending outwardly of the refractory body and forming a support and a conduit for air being introduced into the lance for cooling. Another of the conduits extends completely through the refractory body in coaxial relation and provides a path for a gas stream directed therethrough.

10 Claims, 4 Drawing Figures

AIR COOLED REFRACTORY LANCE

BACKGROUND OF THE INVENTION

1. Technical Field

This invention relates to fluid cooled lances such as used for introducing an inert gas into molten metal for stirring the same or for injecting a stream of oxygen into molten metal for refining the same.

2. Description of the Prior Art

Prior devices of this type may be seen in U.S. Pat. Nos. 3,115,405, 3,379,428, 3,521,872, 3,751,019 and 3,898,078.

In U.S. Pat. No. 3,115,405, a typical prior art lance formed of tubular metal shapes is disclosed, the lance is intended for the introduction of oxygen into molten iron in making steel and is water cooled.

U.S. Pat. No. 3,379,428 discloses a metal lance formed of a plurality of concentric tubular elements and useful in introducing oxygen into molten iron in a metallurgical furnace. The device is water cooled.

U.S. Pat. No. 3,521,872 discloses a metal lance and utilizes an arrangement of introducing water in vapor form into the gas conveyed by the lance into the molten metal.

U.S. Pat. No. 3,751,019 discloses a fluid cooled lance formed of composite refractory and metal for introducing oxygen or other gases into or onto molten metal baths. The tubular metal portions are located within an enclosing refractory sleeve.

U.S. Pat. No. 3,898,078 discloses a metal lance having a nozzle, a portion of which is covered with a refractory material.

The present invention relates to a substantially improved air cooled refractory lance in which the principal body of the lance is formed of refractory material provided with a bore in which metal conduits are positioned and through which cooling air is introduced and removed in a manner creating a positive circulation through the substantially large hollow core of the refractory body. An additional metal conduit positioned off center of the hollow core of the refractory body forms a continuous passageway therethrough for the introduction of oxygen or other gases. The novel construction of the elongated refractory body and its relatively large bore axially thereof throughout most of its length enables air to be effectively used to cool the refractory body and contribute to its substantially longer life than has heretofore been possible with the prior art lances, many of which were water cooled as in the case of the foregoing prior art patents.

SUMMARY OF THE INVENTION

An air cooled refractory lance for introducing inert gas for stirring or for injecting oxygen or another gas into molten metal or slag has an elongated refractory body with a relatively large bore axially thereof and formed with relatively thick wall sections around said bore. The bore terminates inwardly of one end and a plurality of metal conduits are positioned in the bore, one of which forms an extending member by which the lance may be supported and provides a passageway for air introduced into the lance for cooling the same, another conduit provides a return passageway for the air and still another conduit provides a passageway for introducing a fluid through the lance and out of the tip thereof.

DESCRIPTION OF THE PREFERRED EMBODIMENT

Figure 1:
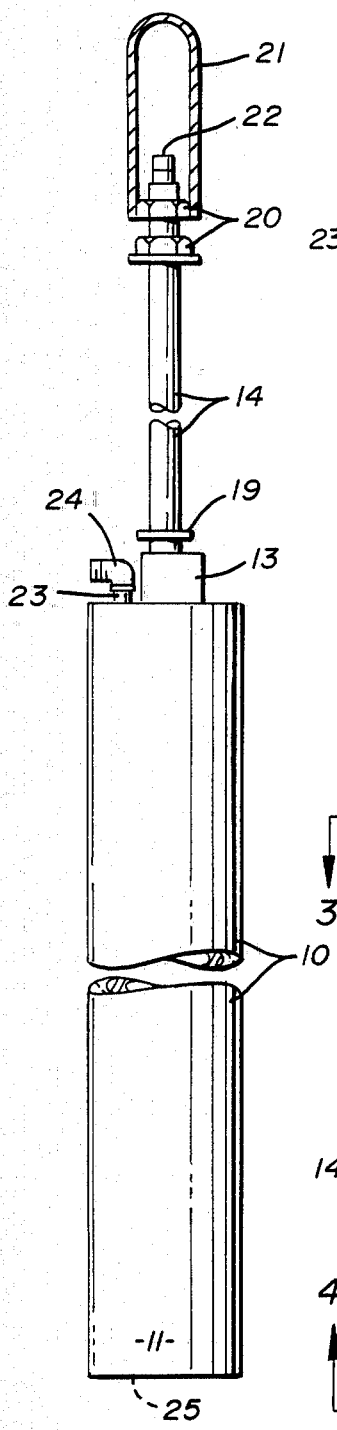
FIG. 1 is a side elevation with parts broken away and parts in cross section illustrating the air cooled refractory lance.

In the form of the invention illustrated and described herein, the air cooled refractory lance comprises an elongated relatively thick walled cross sectionally circular tubular refractory body 10, the tip end 11 of the refractory body 10 is solid and the remainder of the refractory body 10 has a cross sectionally triangular shaped bore 12 extending axially thereof. A cross sectionally triangular metal tube 13 is positioned in the bore 12 and a cross sectionally circular tube 14 is positioned in the cross sectionally triangular metal tube 13 and secured thereto as by spot welds, the combination of the metal tubes 13 and 14 forming three distinct passageways 15, 16 and 17 as best seen in FIG. 3 of the drawings, all of which communicate with one another adjacent the lower end of the tube 14 which is spaced with respect to the lower end of the cross sectionally triangular metal tube 13 which is provided with an end closure 18 as best seen in FIG. 2 of the drawings.

The upper end of the cross sectionally triangular metal tube 13 extends above the upper end of the thick walled cross sectionally circular refractory body 10 and the cross sectionally circular tube 14 extends upwardly and outwardly with respect thereto and forms a convenient handling member. A baffle 19 is attached to the tube 14 in spaced relation to the upper end of the cross sectionally triangular metal tube 13 and a fastener assembly 20 is positioned inwardly of the upper outer end of the tube 14 and includes a bail 21, the upper end of the tube 14 is provided with a reducing fitting 22 to which a compressed air hose may be conveniently attached so that compressed air for cooling may be directed downwardly through the tube 14. The cooling air will emerge from the bottom of the tube 14 as shown by the arrow in FIG. 2 of the drawings and flow upwardly through the three passageways 15, 16 and 17, each of which is defined by two of the three engaging portions of the cross sectionally triangular metal tube 13 as best seen in FIG. 3 of the drawings. The arrangement is such that the interior of the elongated tubular refractory body 10 with its relatively thick walls is uniformly cooled by the cooling air flowing upwardly therethrough and the life of the refractory body 10 thus considerably increased. The cooling air exits from the upper end of the cross sectionally triangular metal tube 13 as shown by the arrows in FIG. 2 of the drawings.

Figure 2:
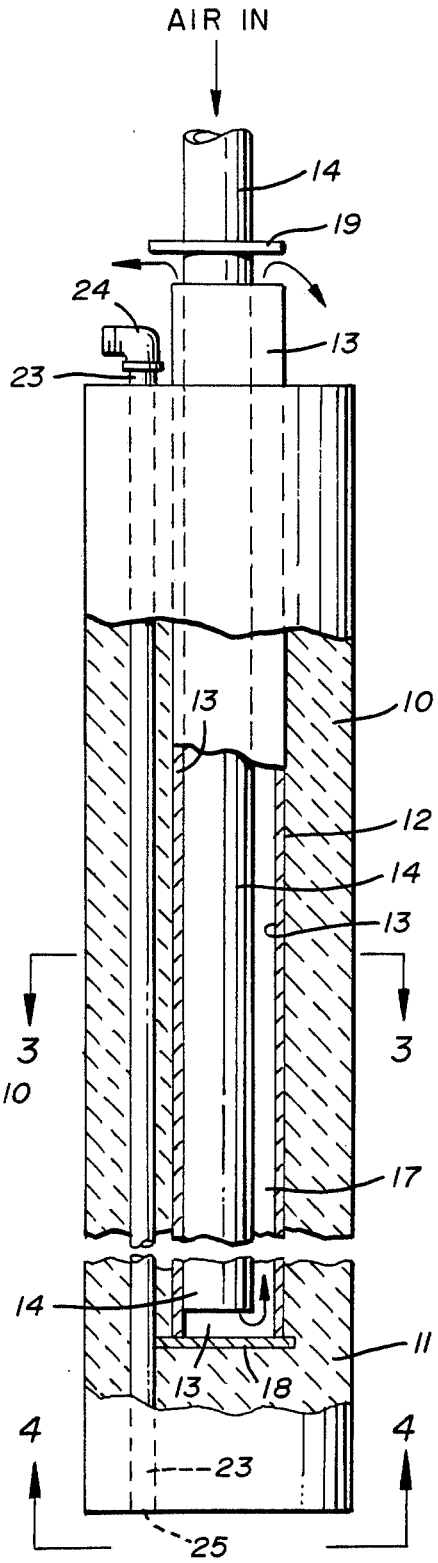
FIG. 2 is an enlarged cross sectional view of a portion of the lance seen in FIG. 1 with parts broken away and parts in cross section.
Figure 3:
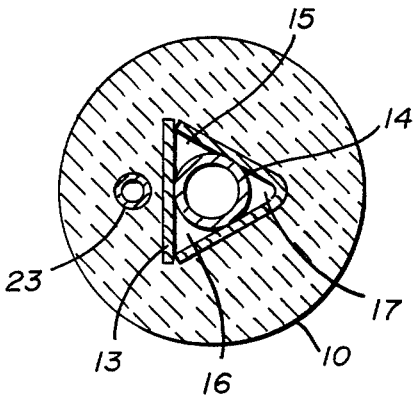
FIG. 3 is a horizontal section on line 3—3 of FIG. 2.
Figure 4:
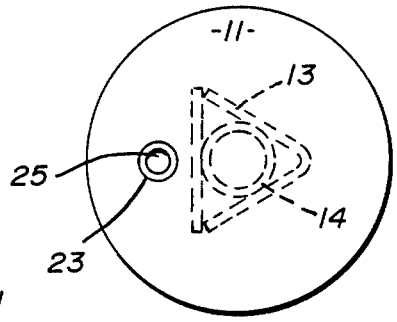
FIG. 4 is a horizontal view on line 4—4 of FIG. 2 showing the tip end of the air cooled refractory lance.

By referring now to FIGS. 1 and 2 of the drawings, it will be seen that a secondary tube 23 provided with an elbow 24 on its upper end is positioned alongside the cross sectionally triangular metal tube 13 and extends longitudinally of and completely through the elongated tubular refractory body 10 and forms an outlet port 25 in the bottom of the tip end 11 of the refractory body 10. Alternately, the outlet port 25 may be positioned in the side of the tip end 11 of the refractory body 10 and by forming a T-shaped passageway on the lower end of the secondary tube 23, multiple outlet ports may be provided. A still further variation is possible by adding a porous member to the tip end 11 of the refractory body 10 and utilizing the porous member as a multiple orificed outlet for stirring gas or the like directed downwardly through the secondary tube 23. The tube 14 may be of several alternate cross sectional shapes, such as square, triangular, etc. The above described air cooled refractory lance forms an efficient relatively simple device for introducing a stirring gas into a molten metal bath or alternately directing an oxygen stream against or into a molten metal bath such as molten iron in refining the same in a steel making process. The elongated tubular refractory body member 10 preferably has a wall thickness at least equal to the largest cross sectional area of the bore 12 therein.

The device of the invention is simply and easily formed and is possessed of an unusually long life as compared with the prior art lances due to the novel and highly efficient air cooling passageways formed in the lance by the novel tubular members incorporated therein.

Although but one embodiment of the present invention has been illustrated and described, it will be apparent to those skilled in the art that various changes and modifications may be made therein without departing from the spirit of the invention and having thus described my invention what I claim is:

I claim:

1. A fluid cooled lance for use in treating a bath of molten metal comprising an elongated tubular refractory body, a pair of tubular metal members arranged coaxially in said elongated refractory body, one of said tubular metal members having a plurality of transversely flat wall sections engaging the inner surface of said elongated tubular refractory body, the other of said tubular metal members disposed within said first mentioned tubular metal member shaped to form a plurality of separate longitudinally extending passageways, said tubular metal members extending outwardly of one end of said elongated tubular refractory body and forming means for introducing a coolant fluid into said lance and directing said coolant fluid therefrom, a secondary tubular member in said elongated tubular refractory body communicating with the opposite ends thereof and means for introducing, stirring and refining gas into said secondary tubular member for delivery by said lance to said molten metal bath and means in communication with one of said pair of tubular metal members for introducing a coolant fluid thereinto, one of said pair of tubular metal members extending outwardly of said elongated tubular refractory body to a greater extent than the other so as to form a handling and supporting means.

2. The fluid cooled lance for use in treating a bath of molten metal as set forth in claim 1 and wherein said one of said tubular metal members having a plurality of transversely flat wall sections is triangular in cross section.

3. The fluid cooled lance for use in treating a bath of molten metal set forth in claim 1 and wherein the other of said tubular metal members disposed within said first mentioned tubular member is cross sectionally circular and ends inwardly of the adjacent end of said tubular metal member having a plurality of transversely flat wall sections.

4. The fluid cooled lance for use in treating a bath of molten metal set forth in claim 1 and wherein said other of said tubular metal members disposed within said first mentioned tubular member is cross sectionally circular.

5. The fluid cooled lance for use in treating a bath of molten metal set forth in claim 1 and wherein said one of said pair of tubular metal members extending outwardly of said elongated tubular refractory body to a greater extent than the other is disposed within said first mentioned tubular member and has means on the outermost end thereof for introducing coolant fluid thereinto.

6. The fluid cooled lance for use in treating a bath of molten metal as set forth in claim 1 wherein said elongated tubular refractory body is cross sectionally circular on its exterior and cross sectionally non-circular on its interior and has a total wall thickness at least equal to the largest cross sectional open area therein.

7. The fluid cooled lance for use in treating a bath of molten metal set forth in claim 1 and wherein a solid refractory tip portion is formed on one end of said elongated tubular refractory body and wherein said secondary tubular member extends therethrough.

8. The fluid cooled lance for use in treating a bath of molten metal set forth in claim 1 and wherein a porous refractory tip is formed on one end of said elongated tubular refractory body and wherein said secondary tubular member communicates with said porous tip.

9. The fluid cooled lance of claim 1 and wherein the other of said tubular metal members is cross sectionally shaped in several transversely flat wall sections.

10. A fluid cooled lance for use in treating a bath of molten metal comprising an elongated tubular refractory body, a pair of tubular members arranged coaxially in said elongated refractory body, one of said tubular members having a plurality of longitudinally extending configurations in its wall sections which engage the inner surface of said elongated tubular refractory body, the other of said tubular members disposed within said first mentioned tubular member and shaped to engage the inner surfaces of said longitudinally extending configurations thereof so as to form a plurality of separate longitudinally extending passageways, said tubular members extending outwardly of one end of said elongated tubular refractory body and forming means for introducing a coolant fluid into said lance and directing said coolant fluid therefrom, a secondary tubular member in said elongated tubular refractory body communicating with the opposite ends thereof and means for introducing stirring and refining gas into said secondary tubular member for delivery by said lance to said molten metal bath and means in communication with one of said pair of tubular members for introducing a coolant fluid thereinto.

* * * * *